US008051587B2

(12) United States Patent
Mills

(10) Patent No.: US 8,051,587 B2
(45) Date of Patent: Nov. 8, 2011

(54) SNOWPLOW SYSTEM, SNOW DEFLECTOR APPARATUS AND KIT

(76) Inventor: David W. Mills, Center Ossipee, NH (US)

( * ) Notice: Subject to any disclaimer, the term of this patent is extended or adjusted under 35 U.S.C. 154(b) by 0 days.

(21) Appl. No.: 12/806,869

(22) Filed: Aug. 23, 2010

(65) Prior Publication Data

US 2011/0113657 A1 May 19, 2011

Related U.S. Application Data

(63) Continuation of application No. 11/899,635, filed on Sep. 7, 2007, now Pat. No. 7,779,563.

(60) Provisional application No. 60/883,004, filed on Dec. 31, 2006.

(51) Int. Cl.
*E01H 5/06* (2006.01)
*E01H 5/04* (2006.01)

(52) U.S. Cl. ..... 37/274; 37/280; 37/281; 37/232

(58) Field of Classification Search ..... 37/234, 37/41, 274, 232, 280, 281; 172/784, 777
See application file for complete search history.

(56) References Cited

U.S. PATENT DOCUMENTS 3,208,166 A * 9/1965 Proulx ..... 37/280
3,231,991 A * 2/1966 Wandscheer et al. ..... 37/280
3,373,515 A * 3/1968 Schneider ..... 37/280
4,208,812 A * 6/1980 Brownly ..... 37/280
5,285,588 A * 2/1994 Niemela et al. ..... 37/234
5,361,519 A * 11/1994 Ciula et al. ..... 37/234
5,375,349 A * 12/1994 Jochim ..... 37/429
5,809,672 A * 9/1998 Jones ..... 37/274
5,894,689 A * 4/1999 Turk ..... 37/281
6,240,660 B1 * 6/2001 Dugas ..... 37/280
6,347,465 B1 * 2/2002 Jensen ..... 37/280
6,408,549 B1 * 6/2002 Quenzi et al. ..... 37/281
6,442,877 B1 * 9/2002 Quenzi et al. ..... 37/281
6,463,683 B1 * 10/2002 Skwarchuk ..... 37/280
7,051,819 B1 * 5/2006 Schenk ..... 172/815
7,100,314 B1 * 9/2006 Jensen ..... 37/281
7,134,227 B2 * 11/2006 Quenzi et al. ..... 37/274
7,261,491 B2 * 8/2007 Rahn et al. ..... 404/104
7,481,011 B2 * 1/2009 Nesseth ..... 37/281

* cited by examiner

*Primary Examiner* — Thomas Will
*Assistant Examiner* — Abigail A Risic
(74) *Attorney, Agent, or Firm* — Michael J. Persson; Catherine E. Napjas; Lawson & Persson, PC

(57) ABSTRACT

A snow deflector apparatus that easily attaches to a snowplow, a kit that includes two snow deflector apparatus and a control system, and to a snowplow system that includes two snow deflector apparatus and a control system. The snow deflector apparatus includes a deflector plate, a deflector plate rotator mechanism and at least one spring. The deflector plate is dimensioned to obstruct at least a substantial portion of the end of the blade of the snowplow such that an amount of snow that is sloughed off of the blade is minimized when the deflector plate is in a deployed position.

12 Claims, 13 Drawing Sheets

SNOWPLOW SYSTEM, SNOW DEFLECTOR APPARATUS AND KIT

CLAIM OF PRIORITY

This application is a continuation of U.S. patent application Ser. No. 11/899,635, filed on Sep. 7, 2007, now U.S. Pat. No. 7,779,563 which claims the benefit of priority of U.S. Provisional Patent Application Ser. No. 60/883,004, filed on Dec. 31, 2006.

FIELD OF THE INVENTION

The present invention relates to the field of vehicle mounted snowplows for removing snow and, in particular, to snowplows and attachments thereto that prevent snow from sloughing off the end of the plow blade during use.

BACKGROUND OF INVENTION

Snow falls and accumulates in many places during the winter months and accumulated snow must be removed from roads, parking lots, driveways, etc., to allow vehicles to safely pass. There are a great number of methods for removing snow, but the most common method is to use a vehicle mounted plow. The most common type of plow is an angled blade plow, which may be moved to channel snow from an area in front of the plow vehicle to an area along the outer edge of the road, street or, in the case of a parking lot, to areas where the snow can be piled away from the parking surface.

Effective and efficient snow plowing requires considerable effort. During the plowing operation, a plow blade may be operated in a straight mode, in which the plow is substantially perpendicular to a direction of travel of the vehicle, or at an angled move, in which the plow is angled left or right relative the direction of travel. In both these position, snow will slough off at least one end of the blade. In the case of the straight mode, it will slough off both ends, which is not desirable. In the angled mode it will slough off the leading end, which is also not desirable. In both positions the ridge or ridges of snow will need to be removed by going over the plowed area a second time or even a third time depending on the depth of the snow. These extra passes double or even triple the time required to do a neat job. Therefore, there is a need for a plow and/or an attachment for existing plows, that will eliminate the need to perform these extra passes and, consequently, decreasing the plow time per job.

There have been a number of attempts to address this problem. Historically, these efforts have involved the addition of structures on each end of the snowplow blade. These structures are generally effective at preventing the sloughing of snow from the ends of the blade when the blade is positioned the straight mode. However, they hinder the operation of the plow when it is used in an angled mode, as the snow cannot easily slide off of the plow blade to form a snow bank Rather, snow is trapped in the area between the blade and the structure and plowed snow must move across the trapped snow to the snow bank. Because the plowed snow tends to stick to the trapped snow, this results in uneven snow banks. Further, because the structure interferes with the compression of the snow bank, it is common for large loose clumps of snow that are not compressed into the snow bank to roll into the roadway. Therefore, there is a need for a plow and/or an attachment for existing plows, which will prevent the sloughing of snow from the blade but will not hinder operation of the plow when it is used in an angled mode.

At least two patents have recognized the problem of preventing the sloughing of snow from the plow blade without hindering operation of the plow when it is used in an angled mode and each have disclosed inventions that purport to overcome it. Each patent is said to accomplish this by including a selectively extendable barrier attachment that may be retracted when the plow is used in an angled mode. Unfortunately, each has significant drawbacks that have prevented either invention from be placed in widespread commercial use.

The first such patent is U.S. Pat. No. 5,903,986, titled "Snow plow with side gate". This patent is directed to a snowplow blade that includes a forward extending gate to catch snow rolling off the snowplow blade. The gate follows a trajectory forward from the curb edge of the plow blade and is said to prevent catching the extension gate with the curb regardless of angulations of the plow blade or the degree of extension. The extension gate extension mechanism may be completely attached to the rear surface of the plow blade to operate independently of angulation of the plow blade.

This patent would appear to succeed at preventing the sloughing of snow from the plow blade without hindering operation of the plow when it is used in an angled mode. However, this will only work for so long as it remains undamaged, and nature of the design makes such damage inevitable. For example, the fixed design of the gate makes it extremely vulnerable to damage when plowing over rough dirt roads, uneven concrete, or asphalt having frost heaves, uneven joints or extending manholes. Further, when plowing parking lots and driveways, it is common to not have enough space to push the snow against existing piles and, therefore, the operator needs to push the piles backward. Unfortunately, existing piles tend to thaw and then refreeze between storms, which puts a great amount of stress on the blade, and attachment, when performing this task. Even in the pulled back position, the side gate of U.S. Pat. No. 5,903,986 cannot withstand the stresses imposed on it under these circumstances. In addition to the risk of damage to the gate, the use of a gate that retracts toward the vehicle either requires the plow to be mounted further in front of the vehicle than is normal or a limitation on the amount of angling of the plow in order to avoid damage to the vehicle. Finally, this device cannot be easily mounted to existing plows, as it requires multiple welds and/or drilling and bolting. Therefore, there is a need for a plow and/or plow attachment that is not prone to damage through normal use, does not requires the plow to be mounted further in front of the vehicle than is normal, does not limit the amount of angling of the plow in order to avoid damage to the vehicle and it relatively easy to attach to existing plows.

The second patent that includes a retractable barrier attachment is U.S. Pat. No. 6,681,505, titled "Snow plow barrier attachment". This patent is directed to a snowplow blade that includes a selectively extendable barrier attachment. The barrier attachment includes a base pivotally secured to the plow blade and secured to one end of each of a number of flexible members that are also engaged by a retraction mechanism for the barrier attachment that is disposed on the blade. The retraction mechanism is used to automatically retract and extend the flexible members as the base is pivoted between a retracted position and a deployed position on the blade. In the deployed position, the flexible members form a wall that prevents snow collected or diverted by the plow blade from passing through the barrier attachment.

This patent would appear to succeed at preventing the sloughing of snow from the plow blade without hindering operation of the plow when it is used in an angled mode, and likewise does not require that the plow be mounted in an extended position or that the angle of the blade be limited. However this attachment is even more prone to damage than the gate disclosed in U.S. Pat. No. 5,903,986. For example, the arm that forms the base of the gate is a relatively thin metal bar that is very easy to damage and would not withstand being jammed into a bank of icy snow when it is extended. Accordingly, to protect the base, the user would need to raise the barriers before reaching the snow pile, which would greatly defeat the purpose of the gate. Further, in dumping a full load of snow at the end of a plow run, it is often necessary to turn the vehicle while the plow remains in straight mode. This turning would cause the snow to be forced against the flexible sides, causing them to collapse. Further, like the gate of U.S. Pat. No. 5,903,986, this barrier is not easily mounted to existing plows.

Therefore, there is a need for a plow and/or an attachment for existing plows, which will prevent the sloughing of snow from the blade, will not hinder operation of the plow when it is used in an angled mode, is not prone to damage through normal use, does not require the plow to be mounted further in front of the vehicle than is normal, does not limit the amount of angling of the plow in order to avoid damage to the vehicle, and is relatively easy to attach to existing plows.

SUMMARY OF THE INVENTION

The present invention is a snow deflector apparatus that easily attaches to a snowplow, a kit that includes two snow deflector apparatus and a control system, and a snowplow system that includes two snow deflector apparatus and a control system.

In its most basic form, the snow deflector apparatus of the present invention includes a deflector plate, a deflector plate rotator mechanism and at least one spring. The deflector plate includes a bottom edge, a front edge, a rear edge, an inside surface and an outside surface and manufactured of a substantially rigid material. A substantial portion of the inside surface and the outside surface of the deflector plate is planar and the deflector plate is dimensioned to obstruct at least a substantial portion of the end of the blade of the snow plow such that an amount of snow that is sloughed off of the blade is minimized when the deflector plate is in a deployed position.

The deflector plate rotator mechanism selectively rotates the deflector plate between the deployed position and an undeployed position. The spring is in communication with the deflector plate and is disposed so as to allow at least a portion of the deflector plate to move upward when the bottom edge of the deflector plate contacts an obstruction and to force the bottom edge of the deflector plate downward when the bottom edge of the deflector plate is no longer in contact with the obstruction.

In the preferred embodiment of the snow deflector apparatus, the deflector plate is manufactured of a metal material and also includes a substantially rounded edge joining the front edge and the bottom edge.

In the preferred embodiment, the deflector plate includes a top portion and a bottom portion, the spring is two springs mounted to the top portion of the deflector plate, and the bottom portion of the deflector plate is in communication with the springs such that the bottom portion of the deflector plate moves upward when the bottom edge of the deflector plate contacts an obstruction and downward when the bottom edge of the deflector plate is no longer in contact with the obstruction. In other embodiments, the deflector plate rotator mechanism includes a shaft rotatably attached to the deflector plate and a housing attached to the shaft and is four springs in communication with the deflector plate and the housing such that both the deflector plate, the housing and the shaft move upward when the bottom edge of the deflector plate contacts an obstruction and downward when the bottom edge of the deflector plate is no longer in contact with the obstruction.

In the preferred embodiment of the snow deflector apparatus, the deflector plate rotator mechanism includes a drive screw in communication with the shaft attached to the deflector plate. In other embodiments, the deflector plate rotator mechanism includes an electric motor in communication with the shaft. In still others, the deflector plate rotator mechanism includes a hydraulic ram in communication with the shaft.

The snow deflector kit is adapted for combination with a snowplow having a blade including a left end, a right end, and a top edge, and a vehicle having at least one source of power, In its most basic form, the snow deflector kit includes a right snow deflector apparatus, a left snow deflector apparatus, attachment means for attaching the left snow deflector apparatus to a left end of the blade of the snowplow and the right snow deflector apparatus to a right end of the blade of the snowplow, and a control system for controlling each deflector plate rotator mechanism. Each of the right snow deflector apparatus and the left snow deflector apparatus includes at least the deflector plate, deflector plate rotator mechanism and the at least one spring of the basic embodiment of the snow deflector apparatus. However, the right snow deflector apparatus and left snow deflector apparatus may take any of the forms of the snow deflector apparatus that are described herein.

In the preferred embodiment of the snow deflector kit, the control system for controlling each deflector plate rotator mechanism includes a left control switch and a right control switch. The left control switch is in communication with the source of power and is adapted to control a flow of power to the deflector plate rotator mechanism of the left snow deflector apparatus such that the deflector plate rotator mechanism rotates the deflector plate to an undeployed position when the blade of the plow is angled to a left position and such that the deflector plate rotator mechanism rotates the deflector plate to a deployed position when the blade of the plow is not angled to a left position. The right control switch in communication with the source of power and is adapted to control a flow of power to the deflector plate rotator mechanism of the right snow deflector apparatus such that the deflector plate rotator mechanism rotates the deflector plate to an undeployed position when the blade of the plow is angled to a right position and such that the deflector plate rotator mechanism rotates the deflector plate to a deployed position when the blade of the plow is not angled to a right position.

In the preferred snow deflector kit, the vehicle is a source of electrical power and the control system for controlling each deflector plate rotator mechanism also includes a left position sensor and a right position sensor. The left position sensor is in electrical communication with the left control switch and is adapted to sense when the blade of the snowplow is angled to a left position and send a signal to the left control switch when the blade of the snowplow is angled to a left position. The right position sensor in electrical communication with the right control switch and is adapted to sense when the blade of the snowplow is angled to a right position and send a signal to the right control switch when the blade of the snowplow is angled to a right position.

The control system of the preferred snow deflector kit also includes a center support, a left positioning linkage disposed between the center support and the left position sensor, and a right positioning linkage disposed between the center support and the right position sensor. The left position linkage is adapted to engage the left position sensor when the blade of the snowplow is angled to a left position and the left position sensor is adapted to sense the engagement of the left position linkage and to send a signal to the left control switch when the blade of the snowplow is angled to a left position. The right position linkage is adapted to engage the right position sensor when the blade of the snowplow is angled to a right position and the right position sensor is adapted to sense the engagement of the right position linkage and to send a signal to the right control switch when the blade of the snowplow is angled to a left position.

The snowplow system of the present invention is adapted for attachment to a vehicle having at least one source of power. In its most basic form, the snowplow system includes a blade, a right snow deflector apparatus and a left snow deflector apparatus, and a control system for controlling each deflector plate rotator mechanism of each apparatus. The right snow deflector apparatus is mounted to the right end of the blade of the snowplow and the left snow deflector apparatus is mounted to the left end of the blade of the snowplow. Each of the right snow deflector apparatus and the left snow deflector apparatus includes at least the deflector plate, deflector plate rotator mechanism and the at least one spring of the basic embodiment of the snow deflector apparatus. However, as noted above in connection with the kit, the right snow deflector apparatus and left snow deflector apparatus may take any of the forms of the snow deflector apparatus that are described herein.

In the preferred embodiment of the snow deflector kit, the control system for controlling each deflector plate rotator mechanism includes a left control switch and a right control switch. The left control switch is in communication with the source of power and is adapted to control a flow of power to the deflector plate rotator mechanism of the left snow deflector apparatus such that the deflector plate rotator mechanism rotates the deflector plate to an undeployed position when the blade of the plow is angled to a left position and such that the deflector plate rotator mechanism rotates the deflector plate to a deployed position when the blade of the plow is not angled to a left position. The right control switch is in communication with the source of power and is adapted to control a flow of power to the deflector plate rotator mechanism of the right snow deflector apparatus such that the deflector plate rotator mechanism rotates the deflector plate to an undeployed position when the blade of the plow is angled to a right position and such that the deflector plate rotator mechanism rotates the deflector plate to a deployed position when the blade of the plow is not angled to a right position.

In the preferred snow deflector kit, the vehicle is a source of electrical power and the control system for controlling each deflector plate rotator mechanism also includes a left position sensor and a right position sensor. The left position sensor is in electrical communication with the left control switch and is adapted to sense when the blade of the snowplow is angled to a left position and send a signal to the left control switch when the blade of the snowplow is angled to a left position. The right position sensor in electrical communication with the right control switch and is adapted to sense when the blade of the snowplow is angled to a right position and send a signal to the right control switch when the blade of the snowplow is angled to a right position.

The control system of the preferred snow deflector kit also includes a center support, a left positioning linkage disposed between the center support and the left position sensor, and a right positioning linkage disposed between the center support and the right position sensor. The left position linkage is adapted to engage the left position sensor when the blade of the snowplow is angled to a left position and the left position sensor is adapted to sense the engagement of the left position linkage and to send a signal to the left control switch when the blade of the snowplow is angled to a left position. The right position linkage is adapted to engage the right position sensor when the blade of the snowplow is angled to a right position and the right position sensor is adapted to sense the engagement of the right position linkage and to send a signal to the right control switch when the blade of the snowplow is angled to a left position.

Finally, some embodiments of the snowplow system include a blade control system having a user interface for controlling a position of the blade. In these embodiments, the left control switch and the right control switch of the control system for controlling each deflector plate rotator mechanism is integrated into the blade control system such that a position of the blade, the right deflector plate and the left deflector plate are each controlled by the user interface of the blade control system.

As should be readily evident, the snow deflector apparatus minimizes the amount of snow that sloughs off the blade when angled blade plowing and overcomes the drawbacks of the prior art snowplows and attachments discussed-above. The apparatus is readily adapted for mounting to snowplow units mounted on existing vehicles, such as pickup trucks, Jeeps, SUV's etc. These vehicles would typically be found in geographic regions where winter snow accumulation must be cleared from driveways, parking lots, streets, etc. The deflector plates of the apparatus are readily adapted to existing plow designs and enhance the ability of the plow to effectively and efficiently move snow in both the straight and angles positions of the plow blade. Generally, the deflector plates can be extended forward of the blade and constantly maintain their position parallel to the forward direction of the plow unit when straight blade plowing. The deflector plates, even though they are at the edge of the blade, do not extend out past the edge of the blade. For this reason they cannot catch on obstructions outside the area of the plow blade regardless of the plow angle.

The kit and snowplow system are preferably designed so that the deflector plates can never be down or move down together when the blade is in the angled position. If the deflector plates are both down for straight away plowing and the operator angles the blade to move the snow left, the left deflector plate, will move upward quickly to its full vertical position. The converse is true if the operator angles the blade to move the snow right. The deflectors are also protected from damage when plowing over uneven surfaces or when rammed into frozen piles of snow, sidewalks, edges of driveways curbs, etc. Just as the plow's scraping blade is protected by kick-up springs so are the deflectors protected by kick-up springs and rounding of the forward point of the deflector.

Therefore, it is an aspect of the invention to provide a plow and/or an attachment for existing plows that will prevent the sloughing of snow from the blade.

It is an aspect of the invention to provide a plow and/or an attachment for existing plows that will not hinder operation of the plow when it is used in an angled mode It is an aspect of the invention to provide a plow and/or an attachment for existing plows that is not prone to damage through normal use.

It is an aspect of the invention to provide a plow and/or an attachment for existing plows that does not requires the plow to be mounted further in front of the vehicle than is normal.

It is an aspect of the invention to provide a plow and/or an attachment for existing plows that does not limit the amount of angling of the plow in order to avoid damage to the vehicle.

It is a still further aspect of the invention to provide a plow and/or an attachment for existing plows that and is relatively easy to attach to existing plows.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
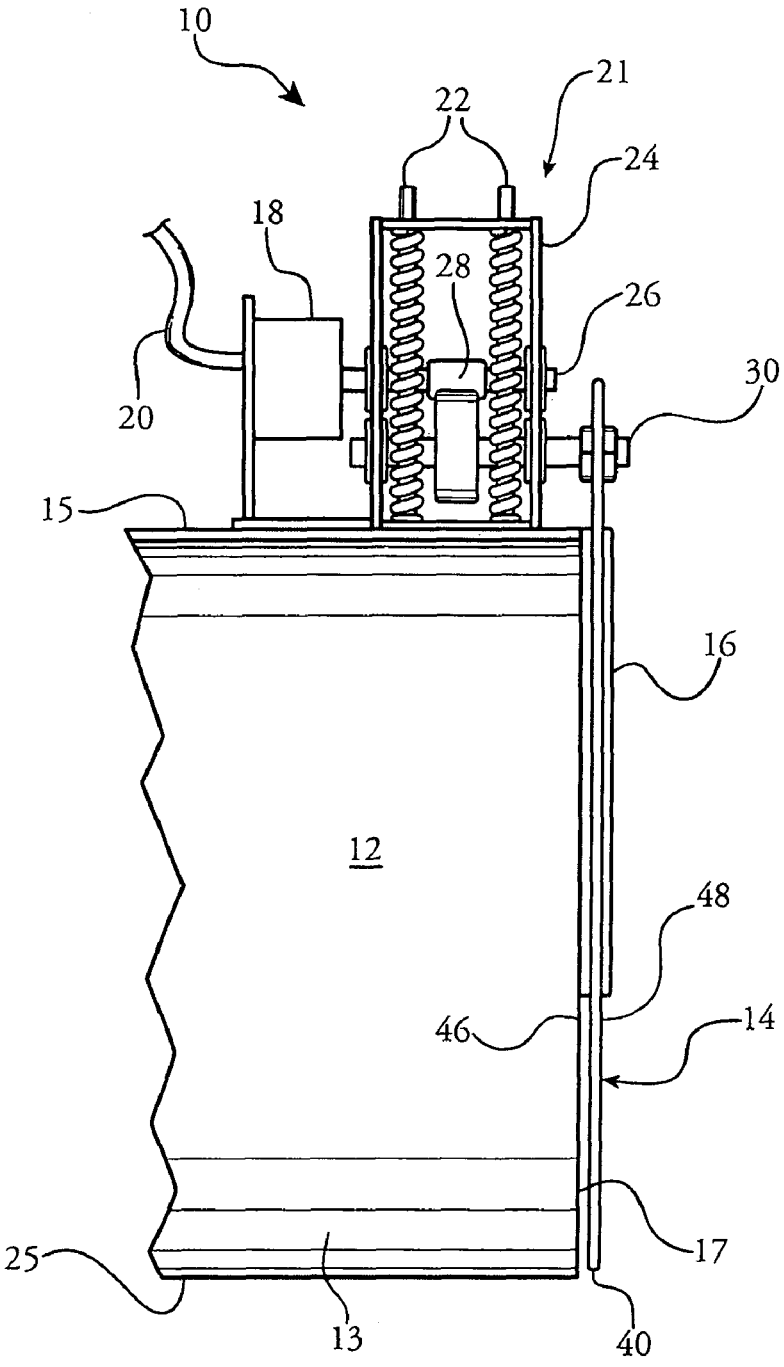
FIG. 1 is partial front view of one embodiment of the present invention in which the snow deflector apparatus utilizes an electric motor to move the deflector plate.
Figure 2:
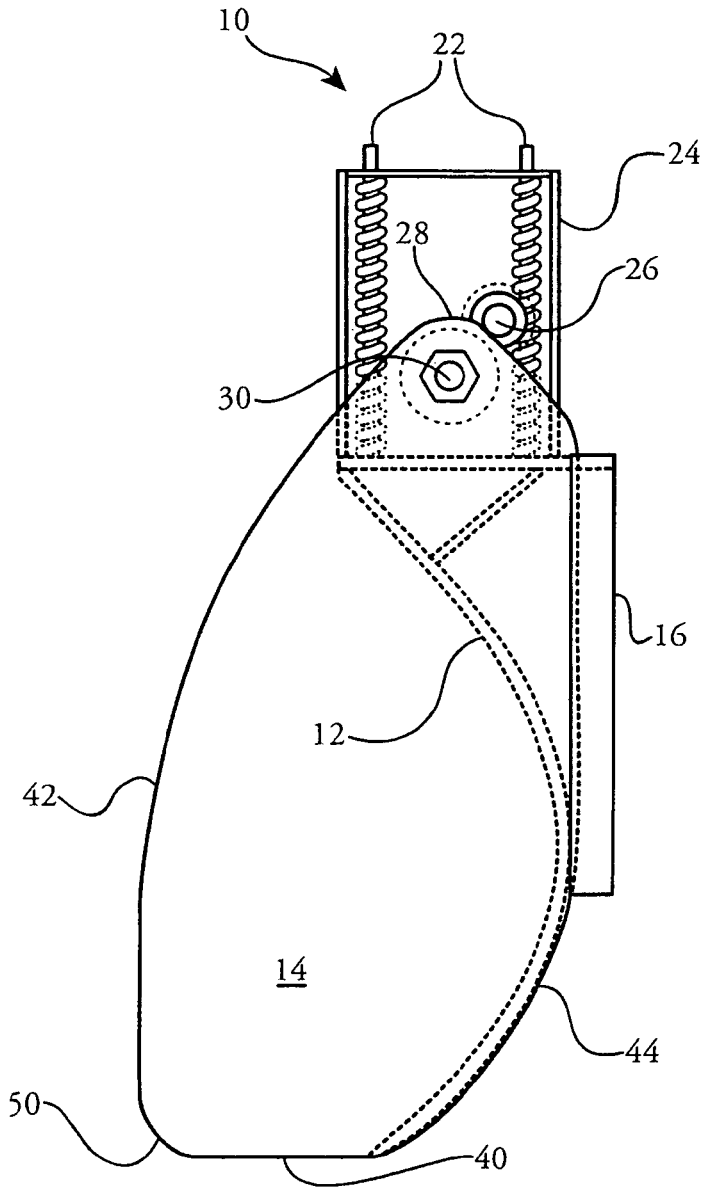
FIG. 2 is a side view of the embodiment of FIG. 1.
Figure 3:
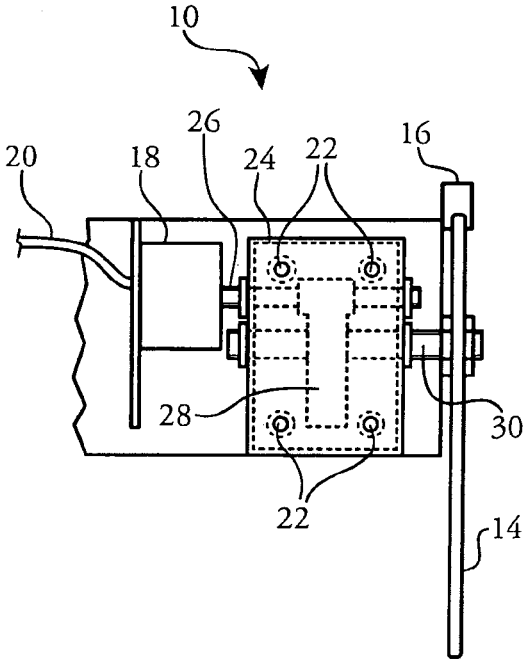
FIG. 3 is a partial top view of the embodiment of FIG. 1.

Referring first to FIGS. 1-3, the snow deflector apparatus 10 is mounted to a support frame 16 proximate to the top edge 15 of the blade 13 of a snowplow 12 and adjacent to one end 17 thereof. The apparatus 10 includes a substantially planar deflector plate 14, a deflector plate rotator mechanism 21 that is attached to the deflector plate 14, a set of four kick up springs 22, and a housing 24 that joins the apparatus 10 to the blade 13 of the snowplow 12.

The deflector plate 14 is manufactured of a substantially rigid material and has a bottom edge 40, a front edge 42, a rear edge 44, an inside surface 46 and an outside surface 48. The preferred material for the deflector plate 14 is metal, but it is recognized that other embodiments may be manufactured of plastic or composite materials. In the preferred embodiment, the deflector plate 14 also includes a substantially rounded edge 50 joining the front edge 42 and the bottom edge 40. The inclusion of a rounded edge 50 is preferred as it helps to prevent the front edge 42 from catching on obstructions during use.

The deflector plate 14 is dimensioned to cover the end 17 of the blade 13 of the snowplow 12 such that an amount of snow that is sloughed off of the blade 13 is minimized when said deflector plate 14 is in a deployed position. In the preferred embodiment, the front edge 42 of the deflector plate 14 is curved at an angle upward and the rear edge 44 is shaped to conform to the curvature of the blade 13 of the snowplow 12. Such a shape is preferred as it allows the rear edge 44 of the deflector plate 14 to rest against the blade 13 of the snowplow. However, in embodiments in which the deflector plate 14 is mounted outside of the edges of the blade 13 of the snowplow 12, the deflector plates 14 may take different shapes.

The deflector plate 14 is preferably between about 0.125 inches and about 0.375 inches thick, with the preferred thickness being 0.250 inches. On most standard sized snowplows 12, the deflector plate 14 will have a height of approximately eighteen inches and a maximum width of approximately ten inches. However, the shape of the deflector plate 14 will vary depending upon the size of the blade 13 of the snowplow 12 and, therefore, these dimensions are for illustrative purposes only.

Figure 9:
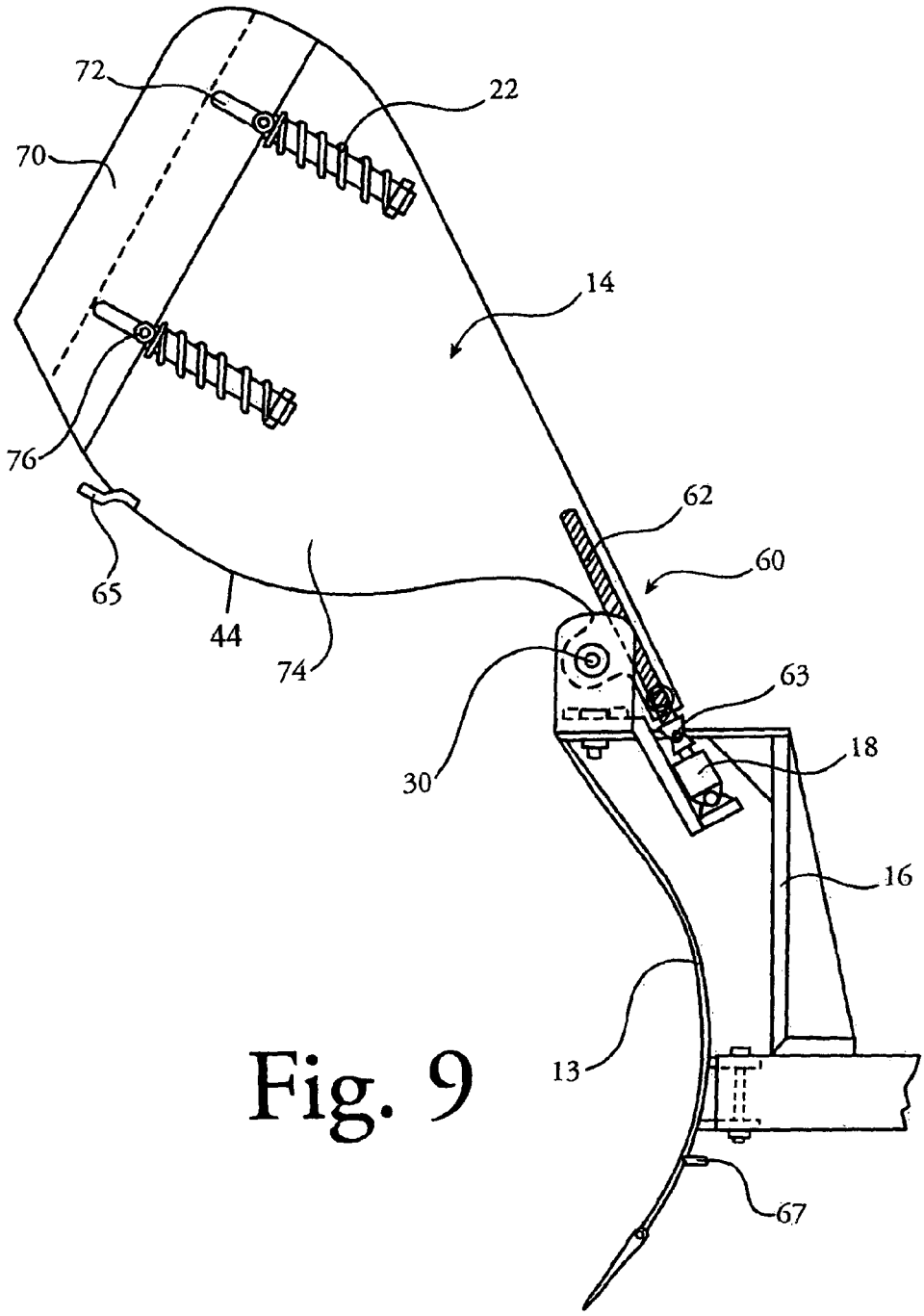
FIG. 9 is a side view of the snow deflector apparatus of FIGS. 7 and 8 attached to a snowplow with the deflector plate in an undeployed position.

The deflector plate rotator mechanism 21 is attached to the deflector plate 14 and is adapted to rotate the deflector plate 14 between the deployed position, as shown in FIGS. 1, 2, 4 and 5, and the undeployed position, as shown in FIG. 9. In the deployed position, the bottom edge 40 of the deflector plate 14 is in substantially parallel relation with the bottom edge 25 of the blade 13 of the snowplow 12 and is disposed between one-quarter inch and one-half inch above the bottom edge 25 of the blade 13. This arrangement prevents snow from sloughing off the end 17 of the blade 13 while reducing the possibility that the deflector plates 14 will be damaged during use. In the undeployed position, the deflector plate 14 is rotated upward such that the bottom edge 40 is at an upward angle relative to the bottom edge 25 of the blade 13. This angle is preferably between 45° and 90°, although other angles are possible.

The deflector plate rotator mechanism 21 may take a number of forms, provided it is adapted to rotate the deflector plate 14 between the deployed position and an undeployed position. In the embodiment of FIGS. 1-3, the deflector plate rotator mechanism 21 includes a shaft 30 that is fixedly attached to the deflector plate 14, an electric motor 18 having a power cord 20 attached to a source of power (not shown), preferably the electrical system of the vehicle to which the apparatus 10 is mounted, and a gear system 28, including main drive shaft 26, that transmits the rotation from the electric motor 18 to the shaft 30 to rotate the deflector plate 14.

Figure 4:
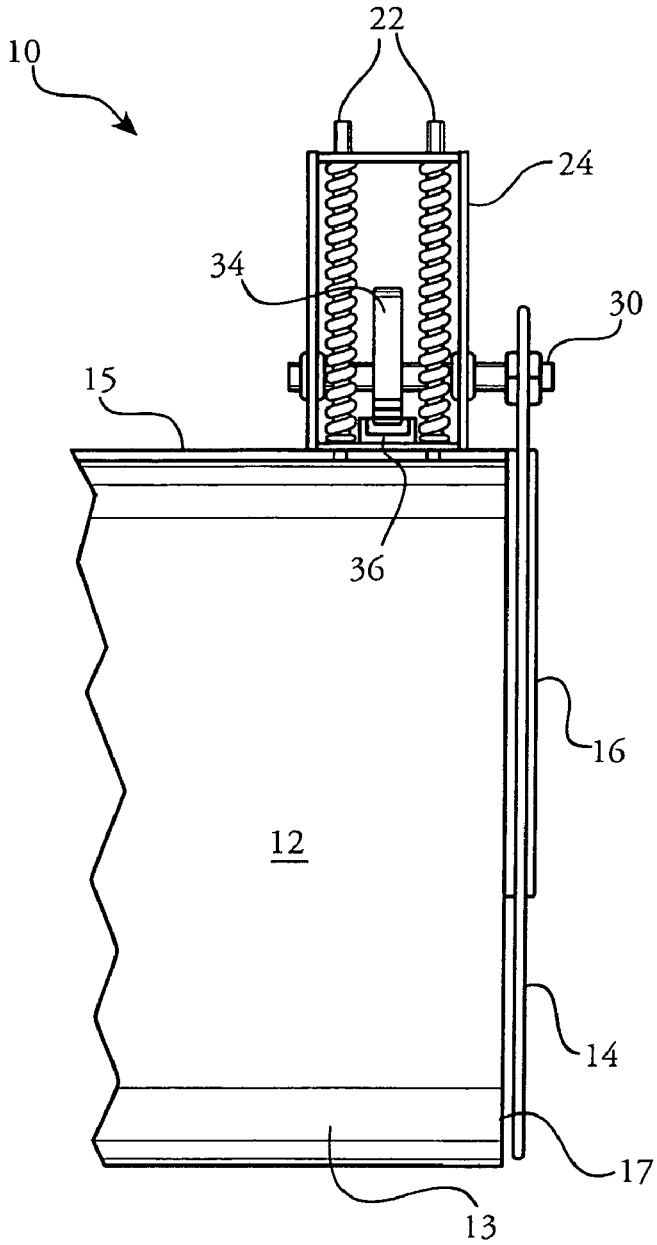
FIG. 4 is partial front view of one embodiment of the present invention in which the snow deflector apparatus utilizes a hydraulic ram to move the deflector plate.
Figure 5:
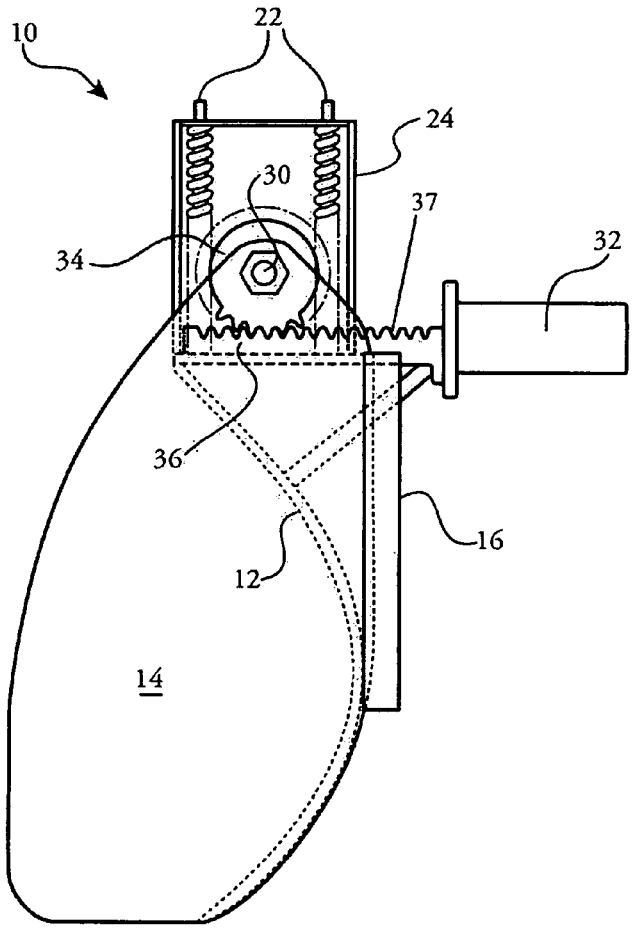
FIG. 5 is a side view of the embodiment of FIG. 4.
Figure 6:
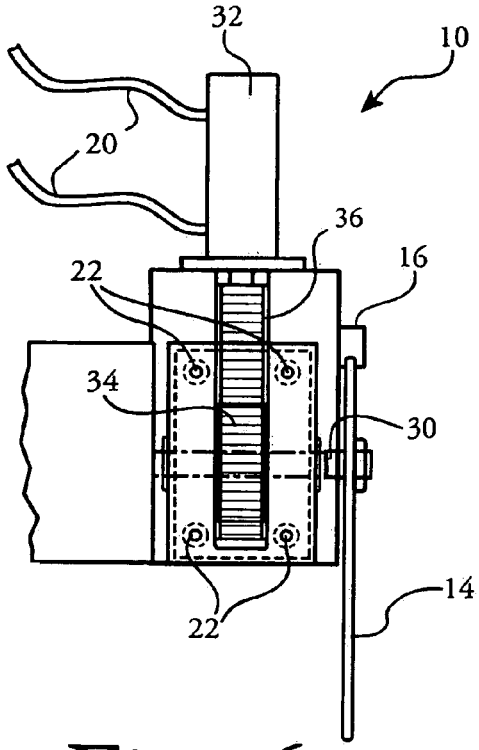
FIG. 6 is a partial top view of the embodiment of FIG. 4.

In the embodiment of FIGS. 4-6, the deflector plate rotator mechanism 21 includes a shaft 30 that is fixedly attached to the rotator plate 14 in a manner similar to that of FIGS. 1-3. However, rather than using a gear system 28 to transfer power from an electric motor 18, the shaft 30 includes a main gear 34 that is fixedly attached to the shaft 30 and is dimensioned to mate with a series of teeth 37 on a rack 36 that is driven by a hydraulic ram 32. In these embodiments, the teeth 37 of the rack 36 are mated with the main gear 34 such that movement of the rack 36 in the direction of the blade 13 of the snowplow 12 causes the main gear 34 to rotate in a clockwise direction, which, in turn, causes the shaft 30 and attached deflector plate 14 to rotate upward to an undeployed position. Conversely, movement of the rack 36 in the opposite direction causes the main gear 34 to rotate in a counterclockwise direction, which, in turn, causes the shaft 30 and attached deflector plate 14 to rotate downward to a deployed position. In embodiments utilizing a hydraulic ram 32, the power source (not shown) for the hydraulic ram 32 is preferably the hydraulic system that is used to power the movement of the blade 13 of the snowplow 12. However, in some embodiments the hydraulic ram 32 includes its own hydraulic pump that is powered by the vehicles electric system.

Figure 7:
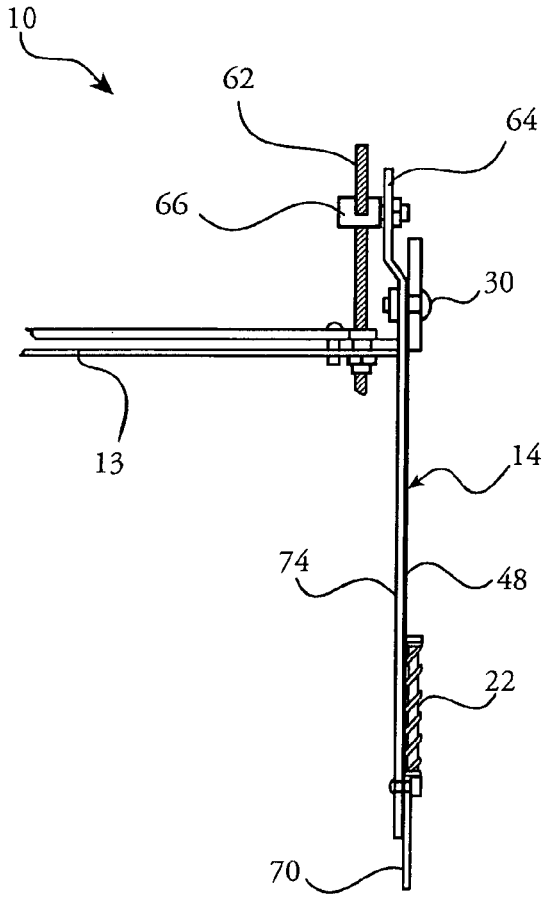
FIG. 7 is partial front view of the preferred embodiment of the present invention in which the snow deflector apparatus utilizes a screw jack to move the deflector plate.
Figure 8:
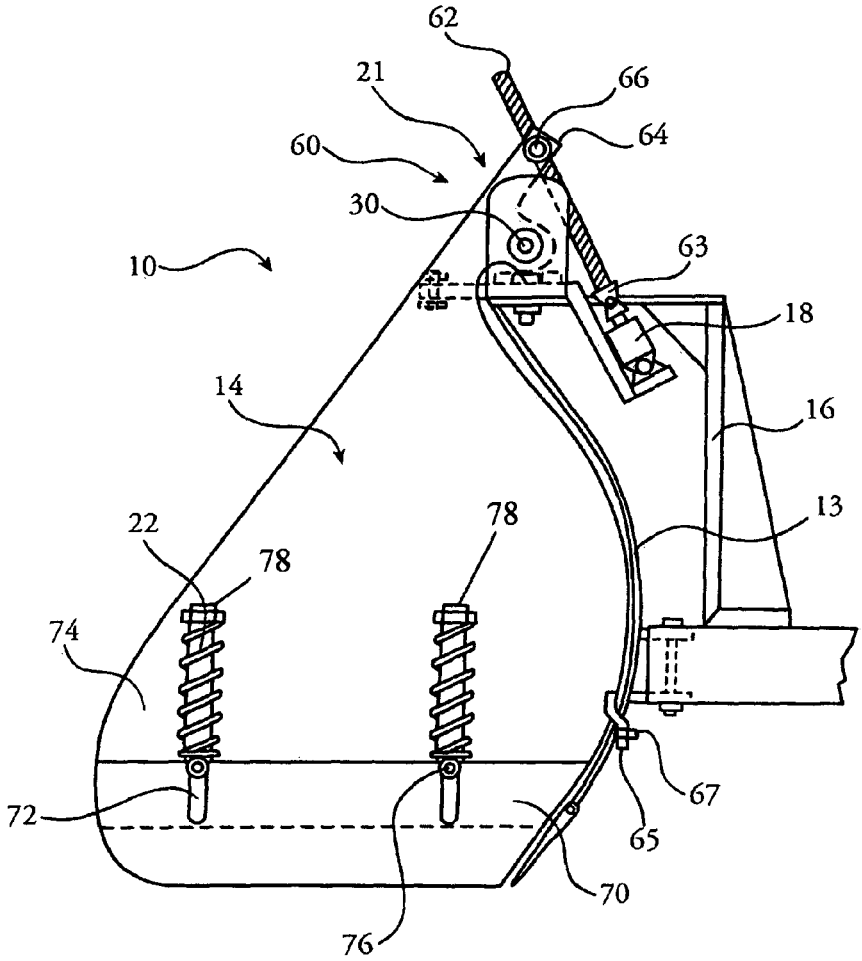
FIG. 8 is a side view of the embodiment of FIG. 7.

In the embodiment of FIGS. 7-9 the deflector plate rotator mechanism 21 includes a shaft 30 that is fixedly attached to the rotator plate 14 and drive screw assembly 60 in communication with the shaft 30. The drive screw assembly includes an electric motor 18 that is in communication with a drive screw 62 via a swivel connector 63, a pivot arm 64 that is fixedly attached to the shaft 30, and a drive nut 66 that is rotatably attached to the pivot arm 64 and through which the drive screw 62 is threaded.

In the embodiment of FIGS. 7-9, the electric motor 18 and attached drive screw 62 are fixedly attached to the support frame 16 proximate to the top edge 15 of the blade 13 of the plow and the electric motor 18 is placed in electrical communication with a power source (not shown), preferably the vehicle's electrical system. In operation, when the electric motor 18 turns the drive screw 62 clockwise, it will cause the drive nut 66 to move downward toward the motor 18, which causes the pivot arm 64 to rotate downward and deflector plate 14 upward to the undeployed position, which is shown in FIG. 9. Conversely, when the electric motor 18 turns the drive screw 62 counterclockwise, it will cause the drive nut 66 to move upward away from the motor 18, which causes the pivot arm 64 to rotate upward and deflector plate 14 downward to the deployed position, which is shown in FIGS. 7-9.

The embodiment of FIGS. 7-9 also includes a lateral support 65 attached to the rear edge 44 of the outside surface 48 of the deflector plate 14. The lateral support 65 is preferably a pin that is bent backward and attached to the outside surface 48 of the deflector plate 14 such that it extends beyond the rear edge 44 thereof. The lateral support 65 sits within a receiver 67, which is preferably a "U" shaped channel attached to the outside edge of the blade 13 of the snowplow. The receiver 67 is preferably significantly wider than the pin so as to allow the deflector plate 14 to move slightly inward and outward, which is important in embodiments in which the control system utilizes position sensors, but is not so wide as to allow the deflector plate 14 to move to a point where it would be damaged due to lateral movement. Although the lateral support 65 is shown in FIGS. 7-9, such a support may be utilized in any of the embodiments of the present invention. Further, in some embodiments, the lateral support 65 is eliminated and the receiver 67 is dimensioned to accommodate the rear edge 44 of the deflector plate 14. In still others, both the lateral support 65 and receiver 67 are omitted altogether.

Regardless of which embodiment of snow deflector rotator mechanism 21 is used, all embodiments of the present invention include at least one spring 22 in communication with the deflector plate 14 to allow the deflector plate 14 to move upward when the bottom edge 40 of the deflector plate 14 contacts an obstruction (not shown) and to force the deflector plate 14 back downward when the bottom edge 40 of the deflector plate is no longer in contact with the obstruction.

In the embodiments of FIGS. 1-6, four springs 22 are fitted into the housing 24. The springs 22 allow the housing 24 to move upward when the deflector plate 14 hits an obstruction, which acts to prevent damage to both the deflector plate 14 and the deflector plate rotator mechanism 21. In the embodiment of FIGS. 7-9, the bottom portion 70 of the deflector plate 14 is separated from the top portion 74 and includes a pair of slots 72 dimensioned to allow pins 76 to slide therein. A pair of posts 78 are attached to the top portion 74 of the deflector plate 14 proximate to the slots 72 in the bottom portion and the springs 22 are disposed about the posts 78. The springs 22 contact the pins 76 and exert a downward force thereon and allow the bottom portion 70 of the deflector plate 14 to move upward when the bottom edge 40 of the deflector plate 14 contacts an obstruction (not shown) and to force the bottom portion of the deflector plate 14 back downward when the bottom edge 40 of the deflector plate is no longer in contact with the obstruction.

It is noted that the mounting of the springs 22 on the deflector plate 14 in the manner shown in FIGS. 7-9 is necessary in embodiments utilizing the drive screw assembly 60, as this assembly is not readily adapted to use the spring system of FIGS. 1-6. However, the spring system shown in FIGS. 7-9 may be utilized in connection with any of the embodiments of the present invention and should not be seen as being limited to those embodiments in which a drive screw assembly 60 is used.

Referring again to FIGS. 1-9, the preferred snow deflector apparatus 10 includes a support frame 16. The support frame 16 is preferably manufactured of metal and is intended to provide additional support to the apparatus 10 and to simplify the mounting of the apparatus 10 onto the blade 13 of the snowplow 12. However, it is recognized that the support frame 16 may be eliminated and the apparatus 10 mounted directly onto the top edge 15 of the blade 13 of the snowplow 12.

Figure 10:
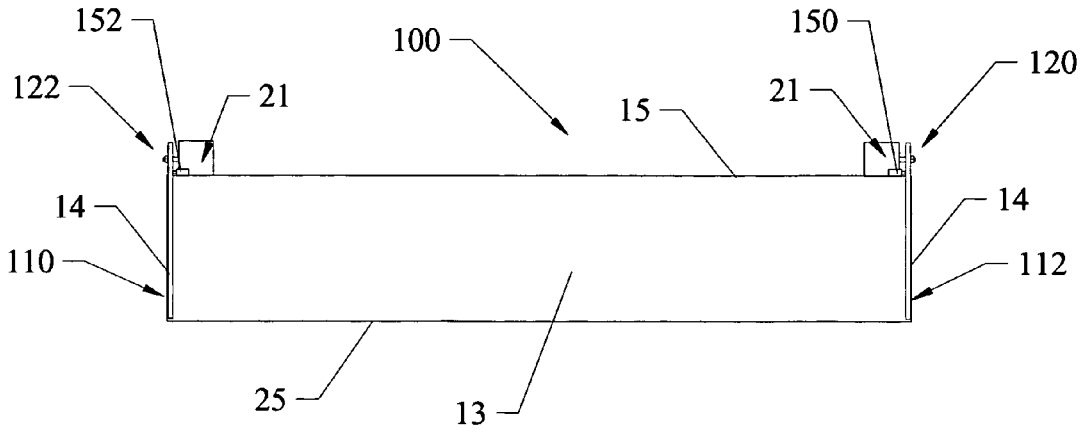
FIG. 10 is a front view of one embodiment of the snowplow system of the present invention.

Referring now to FIG. 10, one embodiment of the snowplow system 100 of the present invention is shown. The snowplow system 100 includes a blade 13 having a left end 110, a right end 112, and a top edge 15, a right snow deflector apparatus 120 and a left snow deflector apparatus 122. The right snow deflector apparatus 120 is mounted to the right end 112 of the blade 13 and the left snow deflector apparatus 122 is mounted to the left end 110 of the blade 13. The right snow deflector apparatus 120 and a left snow deflector apparatus 122 each include a deflector plate 14 and a deflector plate rotator mechanism 21, which may take any of the forms of the snow deflector apparatus 10 described herein. The snowplow system 100 also includes a right position sensor 150 and left position sensor 152. These sensors 150, 152 are preferably microswitch type contact sensors that are placed in close proximity to the deflector plate 14 and part of the control system, such as the control systems 200, 300, 400 shown in FIGS. 12-14, for controlling each deflector plate rotator mechanism 21. The sensors 150, 152 operate based upon the principle that when the blade 13 is angled, each deflector plate 14 has a tendency to move slightly toward the forward edge of the blade 13. Thus, the deflector plate 14 mounted proximate to the rearward edge of the blade 13 will move inward and contact the sensor 150 or 152 and cause the deflector plate rotator mechanism 21 to rotate the deflector plate 14 upward to an undeployed position. When the blade 13 is angled in the opposite direction, the other sensor 150 or 152 will be engaged and the deflector plate 14 proximate to this edge will rotate upward and the other deflector plate 14 will rotate back downward to a deployed position.

Figure 11:
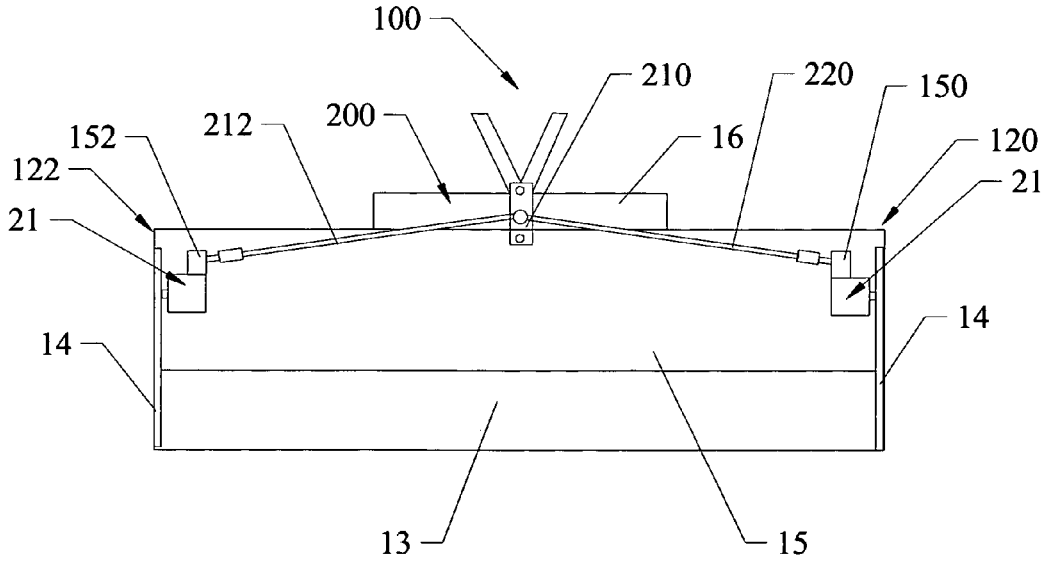
FIG. 11 is a top view of an alternative embodiment of the present invention in which the snow deflector apparatus uses a linkage to control the position of the deflector plates.

FIG. 11 shows an alternative arrangement for automatically moving the deflector plates 14 to a deployed and undeployed position. In this embodiment, the control system 200 includes a center support 210, a left positioning linkage 212 disposed between the center support 210 and a left position sensor 152, and a right positioning linkage 220 disposed between the center support 210 and the right position sensor 150. The positioning linkages 212, 220 are preferably solid threaded linkages that engage position sensors 152, 150 and trigger these sensors when the blade 13 is angled in a particular manner. This is accomplished by disposing the center support 210 such that is it not along the axis of rotation of the blade 13 such that the angling of the blade 13 will cause the linkage 212, 220 proximate to the forward edge of the blade 13 to exert a compressive force on one sensor 152, 150 and the linkage 212, 220 to exert a tensile force upon the other sensor 152, 150. The left positioning linkage 212 is adapted to engage the left position sensor 152 when the blade 13 of the snowplow 12 is angled to a left position and the left position sensor 152 is adapted to sense the engagement of the left position linkage 212 and to send a signal to a left control switch (denoted as reference number 162 in FIGS. 12-14) when the blade 13 of the snowplow 12 is angled to a left position. The right position linkage 220 is adapted to engage the right position sensor 150 when the blade 13 of the snowplow 12 is angled to a right position and the right position sensor 150 is adapted to sense the engagement of the right position linkage 220 and to send a signal to the right control switch (denoted as reference number 160 in FIGS. 12-14) when the blade 13 of the snowplow 12 is angled to a right position. In the embodiment of FIG. 11, each of the linkages 212, 220 extends all the way along the blade 13 to the snow deflector apparatus 122, 120. However, it is recognized the linkages 212, 220 may be coupled to a position sensor 152, 150 located a short distance from the center support 210 and that these sensors may be wired into communication with control switches 162, 160 that control the actuation of the apparatus 122, 120.

It is recognized that the snowplow system 100 of the present invention will appeal to owners of existing snowplows and, accordingly, one embodiment of the invention is a kit for forming the snowplow system 100. The kit includes all of the parts of the snowplow system 100 except for the blade and includes the added element of an attachment for mounting the right snow deflector apparatus 120 and left snow deflector apparatus 122 to an existing snowplow. In the embodiments of FIGS. 1-9, this attachment means includes the support frame 16, which preferably includes a plurality of pre-drilled holes (not shown) that allow the snow deflector apparatus 120, 122 to be easily attached thereto via bolts and nuts, or other art recognized attachment means. However, in other embodiments of the kit, the support frame 16 is omitted and the attachment means is merely the bolts and nuts used to attach the snow deflector apparatus 120, 122 to holes drilled through the blade 13 of the snowplow 12.

Figure 12:
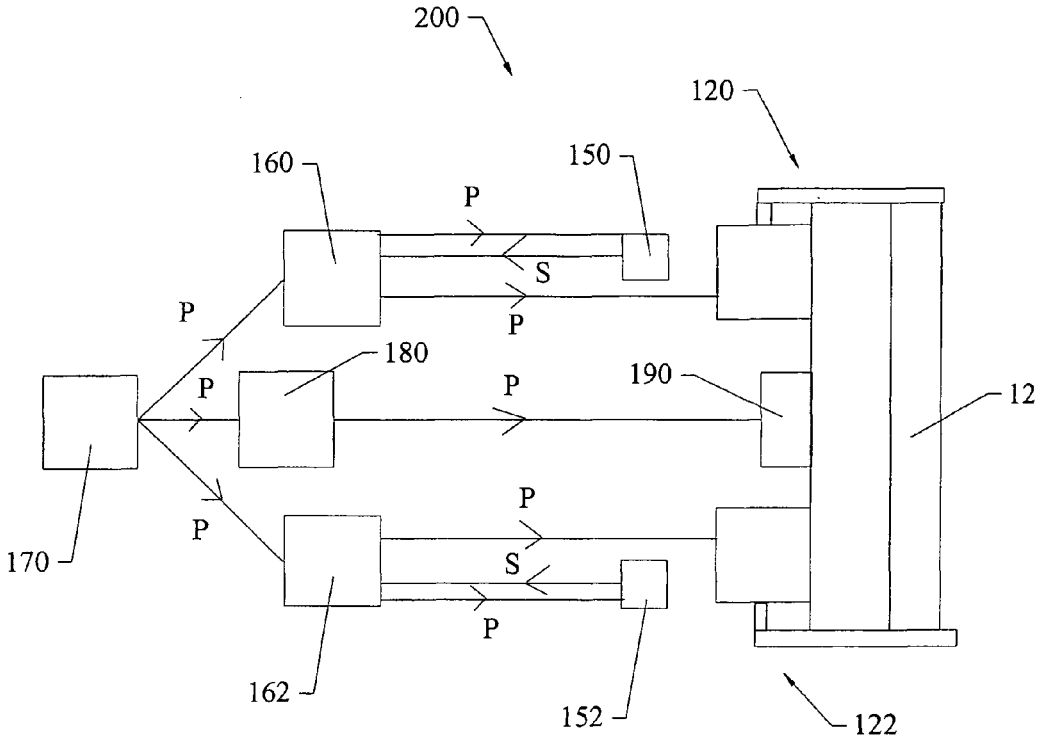
FIG. 12 is a block diagram showing one embodiment of a control system used to control the snow deflector apparatus in connection with the snowplow kit and system of the present invention.
Figure 13:
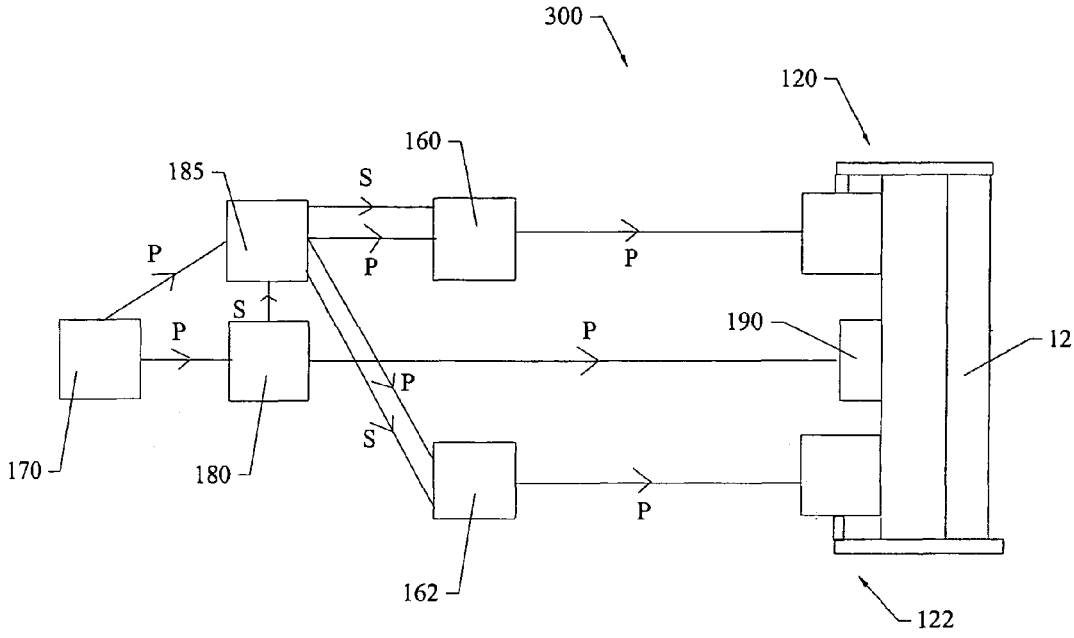
FIG. 13 is a block diagram showing another embodiment of a control system used to control the snow deflector apparatus in connection with the snowplow kit and system of the present invention.
Figure 14:
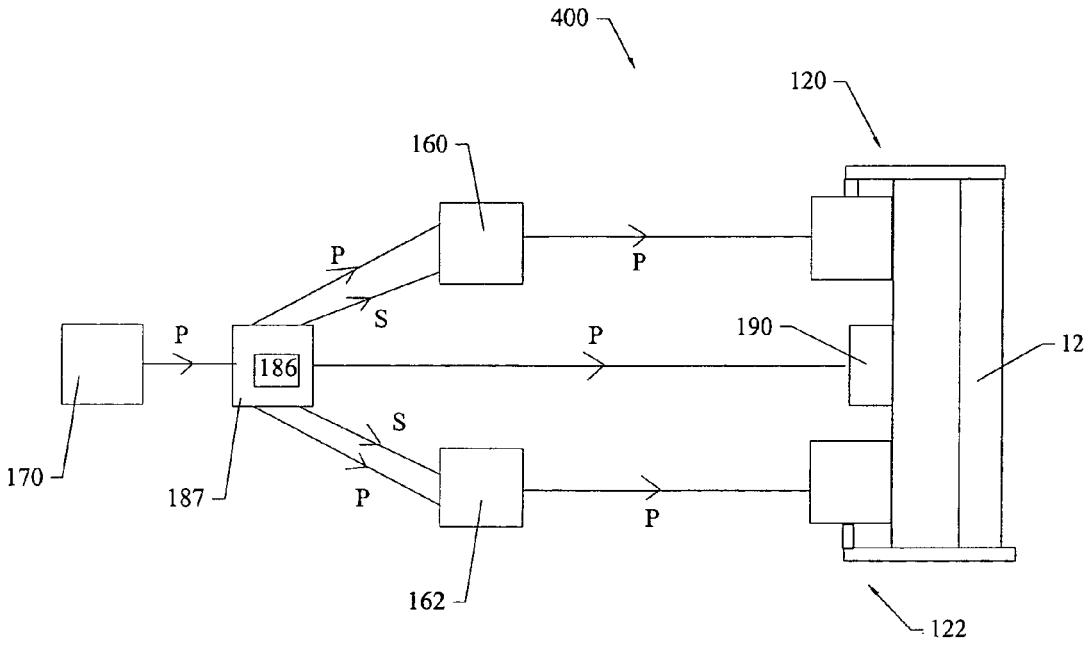
FIG. 14 is a block diagram showing the preferred control system of the snowplow system of the present invention.

Referring now to FIGS. 12-14, three embodiments of control systems 200, 300 and 400 are described. It is noted that the arrows denoted as "P" show a flow of power while those denoted as "S" denote a control signal. Although these are shown as separate lines in the block diagrams, it is noted that both power and signal may be sent through the same cables.

In the embodiment of FIG. 12, power is supplied from a power source 170, such as a vehicle battery, to right control switch 160, left control switch 162, and to the blade control switch 180. The blade control switch 180 controls the flow of power to the blade control apparatus 190. In this embodiment, the blade control switch 180 and blade control apparatus 190 are preferably an existing part of the vehicle that together form the blade control system. The control switches 160, 162 provide power to right and left position sensors 150, 152, which in turn send signals back to the control switches 160, 162 corresponding to the position of the blade 13 of the snowplow 12. The control switches 160, 162 accept the signals from the right and left position sensors 150, 152 and send power to the right and left snow deflector apparatus 120, 122 in order to move the deflector plates 14 thereof to a desired position. It is noted that the block diagram shown in FIG. 12, and the others shown in FIGS. 13 and 14, are not intended to denote the relative positions of the various components. For example, the control switches 160, 162 and position sensors 150, 152 may be mounted proximate to each other, or may each form part of a single electronic assembly.

Referring now to FIG. 13, another embodiment of the control system 300 is shown. In this embodiment of the system 300, the position sensors 150, 152 are eliminated and the position of the blade 13 is determined based upon a signal from the blade control switch 180 to a deflector control 185. As shown in the block diagram, power is supplied from a power source 170 to blade control switch 180 and to deflector control 185. The blade control switch 180 controls the flow of power to the blade control apparatus 190 and, in this embodiment, also sends a signal to deflector control 185 corresponding to a location of the blade 13 of the snowplow 12. The deflector control 185 sends power and signal to right control switch 160 and left control switch 162, which send power to the right and left snow deflector apparatus 120, 122 in order to move the deflector plates 14 thereof to a desired position.

Referring now to FIG. 14, the preferred embodiment of the control system 400 for use with the snowplow system is shown. In this embodiment of the control system 400, the position sensors 150, 152 and deflector control 185 are eliminated and an integrated blade control switch 187 controls both the blade 13 and the snow deflector apparatus 120, 122. As shown in the block diagram, the user will manipulate a user interface 186, such as the joystick type interfaces currently employed in the cabs of plow trucks. The manipulation of this interface 186 causes the blade control switch 187 to alter the position of the blade 13 and simultaneously sends power and signal to right control switch 160 and left control switch 162, which send power to the right and left snow deflector apparatus 120, 122 in order to move the deflector plates 14 thereof to a desired position.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A snow deflector apparatus for mounting to an end of a blade of a snow plow, said apparatus comprising:

a deflector plate comprising a top portion and a bottom portion, wherein each of said top portion and said bottom portion comprise a bottom edge, a front edge, a rear edge, an inside surface and an outside surface, wherein said deflector plate is manufactured of a substantially rigid material, wherein a substantial portion of said inside surfaces of said top portion and said bottom portion of said deflector plate and said outside surfaces of said top portion and said bottom portion of said deflector plate are planar, and wherein said deflector plate is dimensioned to obstruct at least a substantial portion of the end of the blade of the snow plow such that an amount of snow that is sloughed off of the blade is minimized when said deflector plate is in a deployed position;

a deflector plate rotator mechanism adapted to selectively rotate said deflector plate between said deployed position and an undeployed position, said deflector plate rotator mechanism comprising:

a shaft rotatably attached to said deflector plate; and a drive screw assembly in communication with said shaft comprising:

a pivot arm fixedly attached to said shaft;

an electric motor;

a drive screw; and a swivel connector;

wherein said electric motor is in communication with said drive screw through said swivel connector; and at least two springs in communication with said top portion and said bottom portion of said deflector plate, wherein said at least two springs are disposed so as to allow said bottom portion of said deflector plate to move upward when said bottom edge of said bottom portion of said deflector plate contacts an obstruction and to force said bottom edge of said bottom portion of said deflector plate downward when said bottom edge of said bottom portion of said deflector plate is no longer in contact with the obstruction.

2. The snow deflector apparatus as claimed in claim 1 wherein said deflector plate is manufactured of a metal material and further comprises a substantially rounded edge joining said front edge and said bottom edge.

3. A snow deflector kit for combination with a snowplow having a blade comprising a left end, a right end, and a top edge, and a vehicle having at least one source of power, wherein said snow deflector kit comprises:

a right snow deflector apparatus and a left snow deflector apparatus, wherein said right snow deflector apparatus is adapted for mounting to the right end of the blade of the snowplow and said left snow deflector apparatus are adapted for mounting to the left end of the blade of the snowplow, and wherein each of said right snow deflector apparatus and said left snow deflector apparatus comprises:

a deflector plate comprising a top portion and a bottom portion, wherein each of said top portion and said bottom portion comprise a bottom edge, a front edge, a rear edge, an inside surface and an outside surface, wherein said deflector plate is manufactured of a substantially rigid material, wherein a substantial portion of said inside surfaces of said top portion and said bottom portion of said deflector plate and said outside surfaces of said top portion and said bottom portion of said deflector plate are planar, and wherein said deflector plate is dimensioned to obstruct at least a substantial portion of the end of the blade of the snow plow such that an amount of snow that is sloughed off of the blade is minimized when said deflector plate is in a deployed position;

a deflector plate rotator mechanism adapted to selectively rotate said deflector plate between said deployed position and an undeployed position, said deflector plate rotator mechanism comprising:

a shaft rotatably attached to said deflector plate; and a drive screw assembly in communication with said shaft comprising:

a pivot arm fixedly attached to said shaft;

an electric motor;

a drive screw; and a swivel connector;

wherein said electric motor is in communication with said drive screw through said swivel connector; and at least two springs in communication with said top portion and said bottom portion of said deflector plate, wherein said at least two springs are disposed so as to allow said bottom portion of said deflector plate to move upward when said bottom edge of said bottom portion of said deflector plate contacts an obstruction and to force said bottom edge of said bottom portion of said deflector plate downward when said bottom edge of said bottom portion of said deflector plate is no longer in contact with the obstruction;

attachment means for attaching said right snow deflector apparatus to a right end of the blade of the snowplow and said left snow deflector apparatus to a left end of the blade of the snowplow; and a control system for controlling each deflector plate rotator mechanism.

4. The snow deflector kit as claimed in claim 3 wherein said deflector plate of each of said right snow deflector apparatus and said left snow deflector apparatus is manufactured of a metal material and further comprises a substantially rounded edge joining said front edge and said bottom edge.

5. The snow deflector kit as claimed in claim 3 wherein said control system for controlling each deflector plate rotator mechanism comprises:

a left control switch in communication with the source of power, wherein said left control switch is adapted to control a flow of power to said deflector plate rotator mechanism of said left snow deflector apparatus such that said deflector plate rotator mechanism rotates said deflector plate to said undeployed position when the blade of the plow is angled to a left position and such that said deflector plate rotator mechanism rotates said deflector plate to said deployed position when the blade of the plow is not angled to a left position; and a right control switch in communication with the source of power, wherein said right control switch is adapted to control a flow of power to said deflector plate rotator mechanism of said right snow deflector apparatus such that said deflector plate rotator mechanism rotates said deflector plate to said undeployed position when the blade of the plow is angled to a right position and such that said deflector plate rotator mechanism rotates said deflector plate to said deployed position when the blade of the plow is not angled to a right position.

6. The snow deflector kit as claimed in claim 5 wherein one of the at least one source of power of the vehicle is a source of electrical power and wherein said control system for controlling each deflector plate rotator mechanism further comprises:

a left position sensor in electrical communication with said left control switch, wherein said left position sensor is adapted to sense when said blade of said snowplow is angled to a left position and send a signal to said left control switch when said blade of said snowplow is angled to a left position; and a right position sensor in electrical communication with said right control switch, wherein said right position sensor is adapted to sense when said blade of said snowplow is angled to a right position and send a signal to said right control switch when said blade of said snowplow is angled to a right position.

7. The snow deflector kit as claimed in claim 6 wherein said control system for controlling each deflector plate rotator mechanism further comprises a center support, a left positioning linkage disposed between said center support and said left position sensor, and a right positioning linkage disposed between said center support and said right position sensor;

wherein said left position linkage is adapted to engage said left position sensor when said blade of said snowplow is angled to a left position and said left position sensor is adapted to sense the engagement of said left position linkage and to send a signal to said left control switch when said blade of said snowplow is angled to a left position; and wherein said right position linkage is adapted to engage said right position sensor when said blade of said snowplow is angled to a right position and said right position sensor is adapted to sense the engagement of said right position linkage and to send a signal to said right control switch when said blade of said snowplow is angled to a left position.

8. A snowplow system for attachment to a vehicle having at least one source of power, said snowplow system comprising:

a blade comprising a left end, a right end, and a top edge; and a right snow deflector apparatus and a left snow deflector apparatus, wherein said right snow deflector apparatus is mounted to the right end of the blade of the snowplow, said left snow deflector apparatus is mounted to the left end of the blade of the snowplow, and wherein each of said right snow deflector apparatus and said left snow deflector apparatus comprises:

a deflector plate comprising a top portion and a bottom portion, wherein each of said top portion and said bottom portion comprise a bottom edge, a front edge, a rear edge, an inside surface and an outside surface, wherein said deflector plate is manufactured of a substantially rigid material, wherein a substantial portion of said inside surfaces of said top portion and said bottom portion of said deflector plate and said outside surfaces of said top portion and said bottom portion of said deflector plate are planar, and wherein said deflector plate is dimensioned to obstruct at least a substantial portion of the end of the blade of the snow plow such that an amount of snow that is sloughed off of the blade is minimized when said deflector plate is in a deployed position;

a deflector plate rotator mechanism adapted to selectively rotate said deflector plate between said deployed position and an undeployed position, said deflector plate rotator mechanism comprising:

a shaft rotatably attached to said deflector plate; and a drive screw assembly in communication with said shaft comprising:

a pivot arm fixedly attached to said shaft;

an electric motor;

a drive screw; and a swivel connector;

wherein said electric motor is in communication with said drive screw through said swivel connector; and at least two springs in communication with said top portion and said bottom portion of said deflector plate, wherein said at least two springs are disposed so as to allow said bottom portion of said deflector plate to move upward when said bottom edge of said bottom portion of said deflector plate contacts an obstruction and to force said bottom edge of said bottom portion of said deflector plate downward when said bottom edge of said bottom portion of said deflector plate is no longer in contact with the obstruction; and a control system for controlling each deflector plate rotator mechanism.

9. The snowplow system as claimed in claim 8 wherein said deflector plate of each of said right snow deflector apparatus and said left snow deflector apparatus is manufactured of a metal material and further comprises a substantially rounded edge joining said front edge and said bottom edge.

10. The snowplow system as claimed in claim 8 wherein said control system for controlling each deflector plate rotator mechanism comprises:

a left control switch in communication with the source of power, wherein said left control switch is adapted to control a flow of power to said deflector plate rotator mechanism such that said deflector plate rotator mechanism rotates said deflector plate to said undeployed position when the blade of the plow is angled to a left position and such that said deflector plate rotator mechanism rotates said deflector plate to said deployed position when the blade of the plow is not angled to a left position; and a right control switch in communication with the source of power, wherein said right control switch is adapted to control a flow of power to said deflector plate rotator mechanism such that said deflector plate rotator mechanism rotates said deflector plate to said undeployed position when the blade of the plow is angled to a right position and such that said deflector plate rotator mechanism rotates said deflector plate to said deployed position when the blade of the plow is not angled to a right position.

11. The snowplow system as claimed in claim 10 wherein said control system for controlling each a deflector plate rotator mechanism further comprises a center support, a left positioning linkage disposed between said center support and said left position sensor, and a right positioning linkage disposed between said center support and said right position sensor;

wherein said left position linkage is adapted to engage said left position sensor when said blade of said snowplow is angled to a left position and said left position sensor is adapted to sense the engagement of said left position linkage and to send a signal to said left control switch when said blade of said snowplow is angled to a left position; and wherein said right position linkage is adapted to engage said right position sensor when said blade of said snowplow is angled to a right position and said right position sensor is adapted to sense the engagement of said right position linkage and to send a signal to said right control switch when said blade of said snowplow is angled to a left position.

12. The snowplow system as claimed in claim 11 further comprising a blade control system comprising a user interface for controlling a position of said blade;

wherein said left control switch and said right control switch of said control system for controlling each deflector plate rotator mechanism is integrated into said blade control system such that a position of said blade, said right deflector plate and said left deflector plate are each controlled by said user interface of said blade control system.

* * * * *